US010170267B2

(12) United States Patent
Yoneda

(10) Patent No.: US 10,170,267 B2
(45) Date of Patent: Jan. 1, 2019

(54) CURRENT FUSE

(71) Applicant: Dexerials Corporation, Shinagawa-ku, Tokyo (JP)

(72) Inventor: Yoshihiro Yoneda, Utsunomiya (JP)

(73) Assignee: Dexerials Corporation, Shinagawa-ku, Tokyo (JP)

( * ) Notice: Subject to any disclaimer, the term of this patent is extended or adjusted under 35 U.S.C. 154(b) by 21 days.

(21) Appl. No.: 15/027,053

(22) PCT Filed: Oct. 7, 2014

(86) PCT No.: PCT/JP2014/005111

§ 371 (c)(1),
(2) Date: Apr. 4, 2016

(87) PCT Pub. No.: WO2015/052923

PCT Pub. Date: Apr. 16, 2015

(65) Prior Publication Data

US 2016/0240342 A1 Aug. 18, 2016

(30) Foreign Application Priority Data

Oct. 9, 2013 (JP) ..... 2013-212358

(51) Int. Cl.
*H01H 85/12* (2006.01)
*H01H 85/06* (2006.01)
(Continued)

(52) U.S. Cl.
CPC ..... *H01H 85/12* (2013.01); *H01H 69/02* (2013.01); *H01H 85/045* (2013.01);
(Continued)

(58) Field of Classification Search
CPC ..... H01H 85/12; H01H 85/20; H01H 85/06; H01H 85/175; H01H 69/02; H01H 85/08;
(Continued)

(56) References Cited

U.S. PATENT DOCUMENTS 4,320,374 A * 3/1982 Narancic ..... H01H 85/055 337/162
4,337,452 A * 6/1982 Kozacka ..... H01H 85/12 337/231
(Continued)

FOREIGN PATENT DOCUMENTS

JP S48-86337 U 10/1973
JP S56-22754 U 2/1981
(Continued)

OTHER PUBLICATIONS

Onozawa Toshihiko; Yasu Junichi; Hidaka Toshiaki; Murofushi Tatsuya, "Fuse Structure and Connecting Socket", Oct. 31, 1997, Sony Tektronix Corp, Entire Document (Translation of JP 09283000).*
(Continued)

*Primary Examiner* — Jayprakash N Gandhi
*Assistant Examiner* — Stephen S Sul
(74) *Attorney, Agent, or Firm* — Kenja IP Law PC

(57) ABSTRACT

Provided is a current fuse that can improve the rating while also preventing explosive scattering of metal in association with arc discharge and enabling reliable cutting off of a circuit. The current fuse (1) includes an insulating substrate (2), a main fuse element (3) disposed on the insulating substrate (2), and a sub-fuse element (4) disposed on the insulating substrate (2) and having a higher melting point than the main fuse element (3). The main fuse element (3) and the sub-fuse element (4) are connected in parallel.

20 Claims, 17 Drawing Sheets

(51) Int. Cl.

| | |
|---|---|
| ***H01H 85/08*** | (2006.01) |
| ***H01H 85/20*** | (2006.01) |
| ***H01H 69/02*** | (2006.01) |
| ***H01H 85/045*** | (2006.01) |
| ***H01H 85/17*** | (2006.01) |
| ***H01H 85/175*** | (2006.01) |

(52) U.S. Cl.
CPC ..... *H01H 85/06* (2013.01); *H01H 85/08* (2013.01); *H01H 85/17* (2013.01); *H01H 85/175* (2013.01); *H01H 85/20* (2013.01); *H01H 69/022* (2013.01)

(58) Field of Classification Search
CPC .... H01H 85/045; H01H 85/17; H01H 69/022; H01H 2085/0555; H01H 2085/381; H01H 2085/383; H01H 85/36; H01H 85/38
USPC ..... 337/293, 273
See application file for complete search history.

(56) References Cited

U.S. PATENT DOCUMENTS 4,357,588 A * 11/1982 Leach ..... H01H 85/055 337/160
5,159,309 A * 10/1992 Bayer ..... H01H 37/764 337/354
6,501,107 B1 * 12/2002 Sinclair ..... B81B 3/0086 257/208
8,289,122 B2 * 10/2012 Matthiesen ..... H01H 37/761 337/167
2008/0191832 A1 * 8/2008 Tsai ..... H01H 69/022 337/297
2015/0130585 A1 * 5/2015 Nakajima ..... H01H 37/761 337/413
2016/0172143 A1 * 6/2016 Yoneda ..... H01H 85/2045 337/186

FOREIGN PATENT DOCUMENTS

| | | | | |
|---|---|---|---|---|
| JP | 02144821 | A | * 6/1990 | |
| JP | H05-250975 | A | 9/1993 | |
| JP | 09283000 | A | * 10/1997 | |
| JP | H09-283000 | A | 10/1997 | |
| JP | 2002-319345 | A | 10/2002 | |
| JP | 3088901 | U | * 10/2002 | ..... H01H 85/00 |
| JP | 2011-023213 | A | 2/2011 | |
| JP | 2011-175957 | A | 9/2011 | |

OTHER PUBLICATIONS

Oct. 4, 2002, Entire Document (Translation of JP 3088901).*
Itou, Masanori; Suzuki Takao; Yajima Kiyoshi, "Fuse Formation", Jun. 4, 1990, Fujikura LTD, Entire Document (Translation of JP02144821).*
Dec. 9, 2014, International Search Report issued in the International Patent Application No. PCT/JP2014/005111.
May 26, 2017, Office Action issued by the State Intellectual Property Office in the corresponding Chinese Patent Application No. 201480055061.6.
Oct. 30, 2017, Office Action issued by the State Intellectual Property Office in the corresponding Chinese Patent Application No. 201480055061.6.
Mar. 26, 2018, Office Action issued by the State Intellectual Property Office in the corresponding Chinese Patent Application No. 201480055061.6.

* cited by examiner

CURRENT FUSE

CROSS-REFERENCE TO RELATED APPLICATION

This application claims priority of Japanese Patent Application No. 2013-212358 (filed on Oct. 9, 2013), the entire disclosure of which is incorporated herein by reference.

TECHNICAL FIELD

The present disclosure relates to a current fuse that is mounted on a current path and that blows by self-heating to cut off the current path when current exceeding a rating of the current fuse flows.

BACKGROUND

Current fuses that blow by self-heating to cut off a current path when current exceeding a rating thereof flows are in conventional use. A typically provided current fuse is made from a low melting point metal such as Pb solder. Examples of commonly used fuse elements include a holder-fixed fuse in which solder is enclosed in a glass tube, a chip fuse in which an Ag electrode is printed on the surface of a ceramic substrate, and a screw-fastened or plug fuse in which part of a copper electrode is narrowed and assembled into a plastic case.

CITATION LIST

Patent Literature

PTL 1: JP2002-319345 A

SUMMARY

Technical Problem

Improvement in the rated currents of current fuses such as described above is demanded in order to respond to increases in capacity and improvements in ratings of electrical devices, batteries, and so forth in which these current fuses are mounted.

In the case of a surface-mountable current fuse in which a fuse element made from a low melting point metal is mounted on a substrate, when a voltage exceeding the rating is applied and a large current flows to blow the current fuse, an arc discharge is generated that causes melting of the fuse element over a wide area and explosive scattering of vaporized metal. Therefore, there is a concern that scattered metal may form a new current path or become attached to terminals, surrounding electronic components, and so forth.

Examples of current fuses that have been proposed in order to quickly stop arc discharge and cut off a circuit include an current fuse in which an arc-extinguishing material is enclosed in a hollow case and a current fuse that is compatible with high voltages and in which a time lag is created through winding of a fuse element in a spiral around a heat dissipating material. However, conventional current fuses that are compatible with high voltages require complicated materials or processing, such as enclosing an arc-extinguishing material or manufacturing a spiral fuse, which is disadvantageous from a viewpoint of reducing the size and raising the rated current of a fuse element.

As described above, there is demand for development of a current fuse that can improve the rating while also preventing explosive scattering of low melting point metal in association with arc discharge and enabling reliable cutting off of a circuit.

Solution to Problem

In order to solve the problem described above, a current fuse according to the present disclosure includes an insulating substrate, a main fuse element disposed on the insulating substrate, and a sub-fuse element disposed on the insulating substrate and having a higher melting point than the main fuse element, wherein the main fuse element and the sub-fuse element are connected in parallel.

Another current fuse according to the present disclosure includes a main fuse element and a sub-fuse element having a higher melting point than the main fuse element, wherein a resistance value of the main fuse element is less than or equal to a resistance value of the sub-fuse element, and the main fuse element and the sub-fuse element are connected in parallel.

Advantageous Effect

According to the present disclosure, the main fuse element with a relatively low melting point and the sub-fuse element with a relatively high melting point are connected in parallel such that current flows to the high melting point sub-fuse element once the low melting point main fuse element blows. Since current flows to the sub-fuse element from the moment that the main fuse element blows, generation of an arc discharge at the main fuse element is prevented and an arc discharge generated when the high melting point sub-fuse element blows is of a relatively small scale. As a result, the rating can be improved while also preventing explosive scattering of low melting point metal in association with arc discharge.

DETAILED DESCRIPTION

Figure 1A:
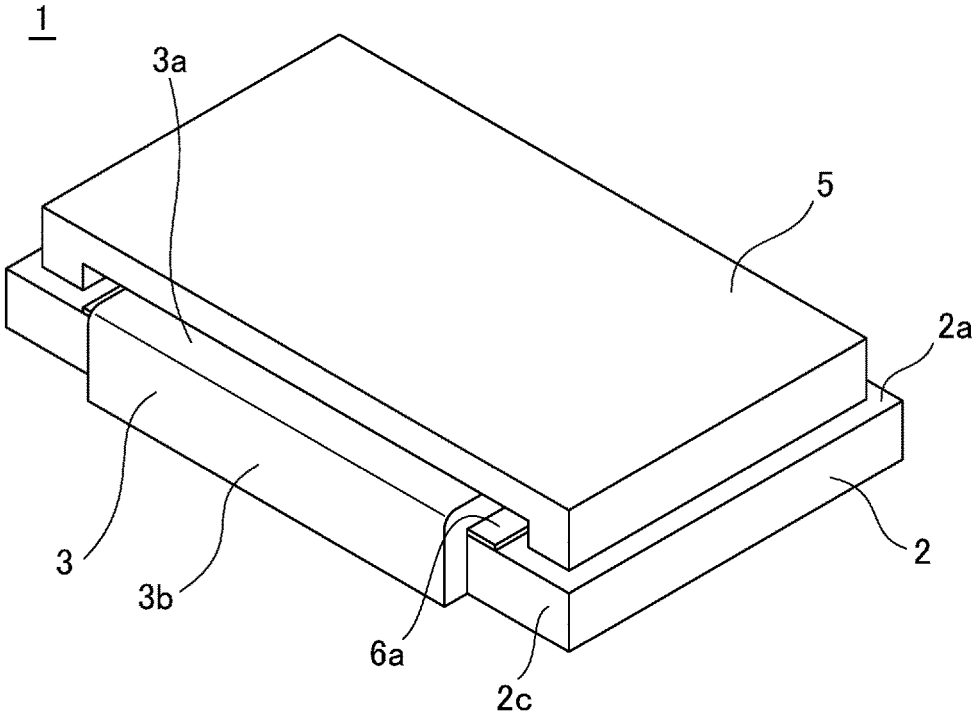
FIG. 1A is an external perspective view of a first surface side and FIG. 1B is an external perspective view of a second surface side, each illustrating a current fuse to which the present disclosure is applied.

The following refers to the drawings to provide a detailed description of a current fuse to which the present disclosure is applied. It should be noted that the present disclosure is not limited to the following embodiments and various alterations may of course be made without deviating from the essence of the present disclosure. Moreover, the drawings are schematic and the ratios of dimensions in the drawings may differ from the actual ratios. Specific dimensions and the like should be determined in light of the following description. Furthermore, the relationship between dimensions and the ratio thereof may of course differ between drawings.

Figure 1B:
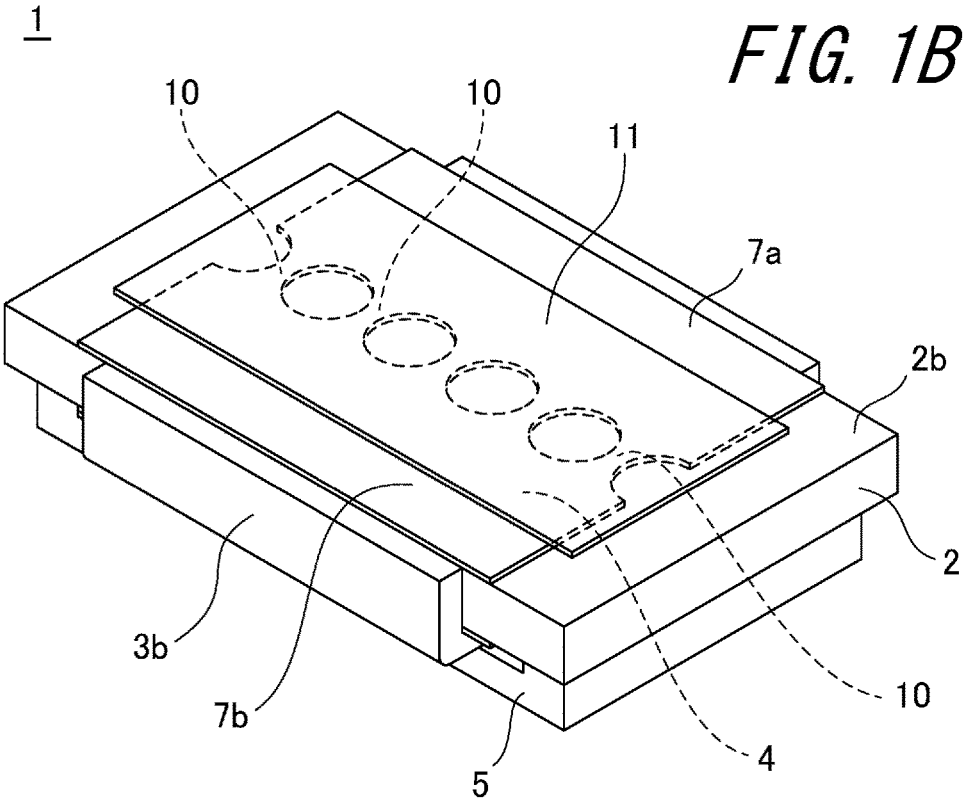

A current fuse 1 to which the present disclosure is applied is surface mountable on a circuit substrate. As illustrated in FIGS. 1A and 1B, the current fuse 1 includes an insulating substrate 2, a main fuse element 3 disposed on the insulating substrate 2, and a sub-fuse element 4 disposed on the insulating substrate 2 and having a higher melting point than the main fuse element 3. By mounting the current fuse 1 on the circuit substrate, the main fuse element 3 and the sub-fuse element 4 are connected in parallel in the circuit.

[Insulating Substrate]

The insulating substrate 2 is an insulating member made from alumina, glass-ceramic, mullite, zirconia, or the like and has a roughly rectangular plate shape. Among such materials, it is preferable for the insulating substrate 2 to be made from a ceramic material having excellent heat shock resistance and high thermal conductivity such that the insulating substrate 2 takes away heat from the main fuse element 3 and the sub-fuse element 4, explained further below, and suppresses arc discharge. Besides the above materials, the insulating substrate 2 can be made from materials used for printed wiring substrates such as glass-epoxy substrates and phenolic substrates, but it is necessary to take into consideration the temperature at which blowing of the main fuse element 3 and the sub-fuse element 4—that is, the fusible conductors—occurs.

Figure 2:
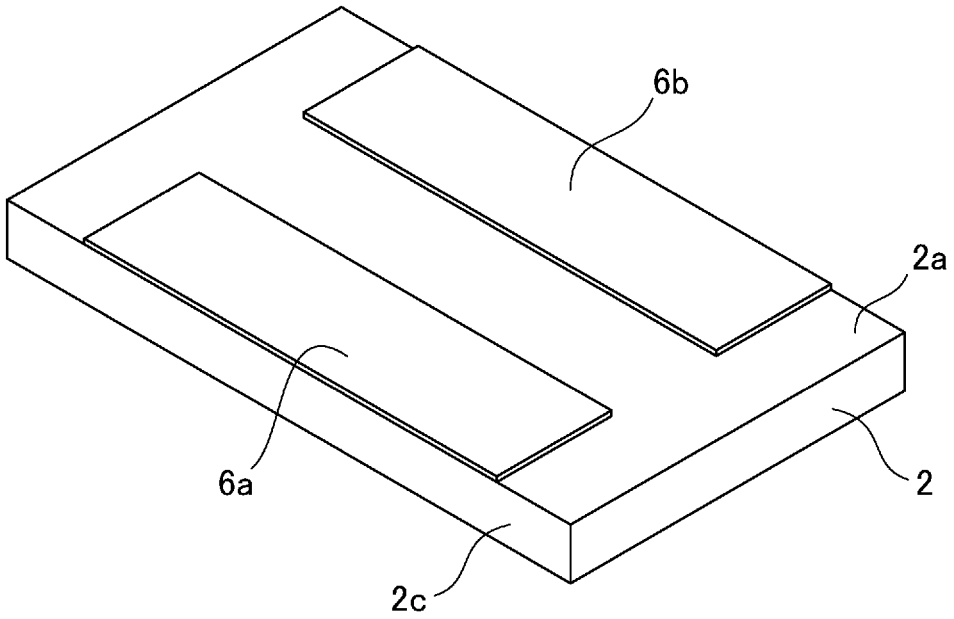
FIG. 2 is an external perspective view of the first surface side illustrating an insulating substrate.

The insulating substrate 2 has a first surface 2*a* on which the main fuse element 3 is mounted and a second surface 2*b*, which is an opposite surface of the insulating substrate 2 relative to the first surface 2*a*, on which the sub-fuse element 4 is disposed. As illustrated in FIG. 2, a pair of main electrodes 6*a* and 6*b* connected to the main fuse element 3 is disposed on opposite edge sections of the first surface 2*a*. The main electrodes 6*a* and 6*b* can for example be formed by patterning of a high melting point metal such as Ag, Cu, or an alloy having Ag or Cu as a main component.

[Main Fuse Element]

The main fuse element 3 can be made from any metal that blows by self-heating when current exceeding the rating flows and can for example be made from a low melting point metal such as solder having Pb as a main component. However, in such a situation, care should be taken to comply with environmental requirements such as RoHS.

The main fuse element 3 may contain a low melting point metal and a high melting point metal. The low melting point metal is preferably solder, such as Pb-free solder having Sn as a main component, and the high melting point metal is preferably Ag, Cu, or an alloy having Ag or Cu as a main component. As a result of the main fuse element 3 containing both the high melting point metal and the low melting point metal, external leakage of the low melting point metal can be restricted and the shape of the main fuse element 3 can be maintained when the current fuse 1 is reflow mounted on the circuit substrate, even in a situation in which the low melting point metal melts due to the reflow temperature exceeding the melting temperature of the low melting point metal. Furthermore, blowing can occur quickly at a temperature that does not exceed the melting point of the high melting point metal since the low melting point metal melts and erodes (solder erosion) the high melting point metal when blowing occurs. The main fuse element 3 can adopt various configurations as described further below.

The main fuse element 3 is mounted across the main electrodes 6*a* and 6*b* that are separated from one another on the first surface 2*a* of the insulating substrate 2. The main fuse element 3 is connected onto the main electrodes 6*a* and 6*b* via a low melting point metal such as solder.

Figure 3:
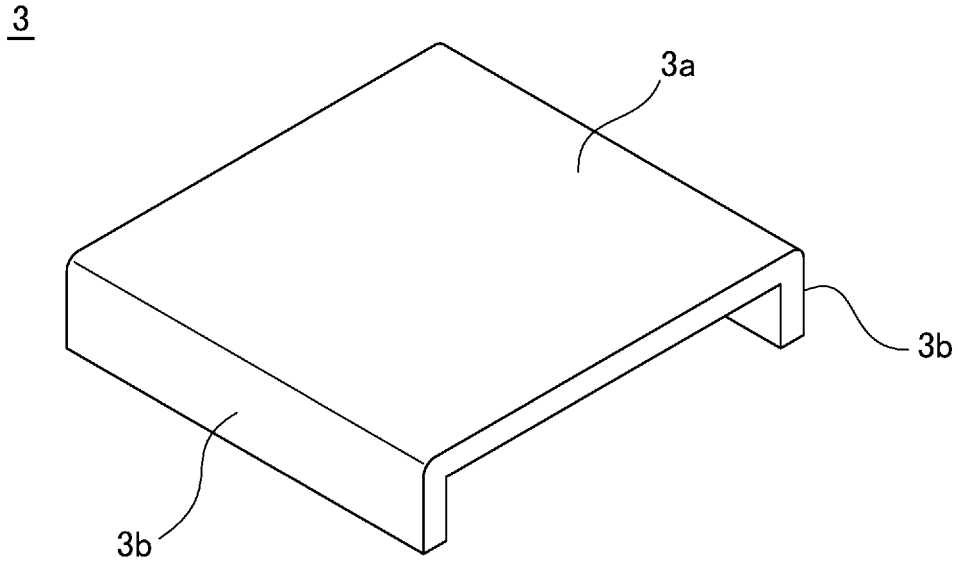
FIG. 3 is a perspective view illustrating a main fuse element.

As illustrated in FIG. 3, the main fuse element 3 includes a main surface section 3*a* that is disposed on the first surface 2*a* of the insulating substrate 2 and side wall sections 3*b* that stand up from opposite edges of the main surface section 3*a* and that are fitted with opposite side surfaces 2*c* and 2*d* of the insulating substrate 2 that are adjacent to the edge sections on which the main electrodes 6*a* and 6*b* are disposed. The side wall sections 3*b* are approximately the same height as the side surfaces 2*c* and 2*d* of the insulating substrate 2 and are fitted with the side surfaces 2*c* and 2*d* such that tips thereof are positioned at a height in substantially a single plane with the second surface 2*b* of the insulating substrate 2. The main fuse element 3 is connected into the circuit by connecting the tips of the side wall sections 3*b* to connection electrodes disposed on the circuit substrate.

Note that the side wall sections 3*b* of the main fuse element 3 may further bend toward the second surface 2*b* of the insulating substrate 2 such that the side wall sections 3*b* are fitted with the side surfaces and the second surface 2*b* of the insulating substrate 2. In this situation, the tips of the side wall sections 3*b* are connected to sub-electrodes 7*a* and 7*b* such that the main fuse element 3 is connected to the sub-fuse element 4 in parallel via the sub-electrodes 7*a* and 7*b*.

The current fuse 1 further includes a protective cap 5 that is disposed over the first surface 2*a* on which the main fuse element 4 is mounted. The protective cap 5 is mounted on the first surface 2*a* of the insulating substrate 2, straddling the main fuse element 3, so as to protect the main fuse element 3 and press the main fuse element 3 against the insulating substrate 2. The protective cap 5 is made from a nylon or LCP plastic that is resistant to the reflow temperature.

[Sub-Fuse Element]

The sub-fuse element 4 is disposed on the second surface 2*b* of the insulating substrate 2 as illustrated in FIG. 1B. The sub-fuse element 4 suppresses arc discharge by forming a bypass path for a large electric current when the main fuse element 3 blows. The sub-fuse element 4 is a conductive pattern that joins the sub-electrodes 7*a* and 7*b* disposed at opposite edges of the second surface 2*b*. The sub-fuse element 4 is made from a metal having a higher melting point than the main fuse element 3, such as Ag, Cu, or an alloy having Ag or Cu as a main component.

The sub-fuse element 4 can be formed from the same material, at the same time, and integrally with the sub-electrodes 7*a* and 7*b* disposed on the second surface 2*b*. For example, the sub-fuse element 4 can be formed in conjunction with the sub-electrodes 7*a* and 7*b* through pattern printing of a high melting point metal on the second surface 2*b* of the insulating substrate 2.

The sub-fuse element 4 is connected into the circuit by connecting the sub-electrodes 7*a* and 7*b*, via a low melting point metal such as solder, to the connection electrodes of the circuit substrate on which the current fuse 1 is mounted. As a result, the sub-fuse element 4 is connected in parallel to the main fuse element 3, which is also connected to the connection electrodes of the circuit substrate via the side wall sections 3*b*.

When current exceeding the rating flows, the sub-fuse element 4 blows after the main fuse element 3 has blown since the sub-fuse element 4 has a higher melting point than the main fuse element 3. Consequently, the sub-fuse element 4 forms a bypass path for a large electric current when the main fuse element 3 blows. Therefore, the current fuse 1 can inhibit explosive scatting of melted metal from the main fuse element 3 in association with arc discharge because an electrical potential causing arc discharge does not arise between the main electrodes 6*a* and 6*b*.

[Resistance Value]

The sub-fuse element 4 has a resistance value that is greater than or equal to a resistance value of the main fuse element 3. Consequently, the majority of current flows through the main fuse element 3 in the current fuse 1 such that the main fuse element 3 generates heat and blows first when current exceeding the rating flows. In other words, as a result of the sub-fuse element 4 having a high melting point and a high resistance relative to the main fuse element 3, the current fuse 1 ensures that the majority of current normally flows through the main fuse element 3 and that current flows through the sub-fuse element 4 after the main fuse element 3 blows.

[Cut Off Section]

The sub-fuse element 4 preferably includes a cut off section 10 at which the sub-fuse element 4 narrows. As a result of the cut off section 10 being narrower than other sections of the sub-fuse element 4, the cut off section 10 is a high resistance section. Therefore, after the main fuse element 3 blows, the sub-fuse element 4 generates heat and blows quickest at the cut off section 10 when current exceeding the rating flows. The current fuse 1 cuts off a current path through blowing of the cut off section 10.

Moreover, since it is the narrow cut off section 10 that blows, the current fuse 1 can inhibit explosive scattering even if an arc discharge is generated because the amount of melted metal from the cut off section 10 is small.

The sub-fuse element 4 may include a plurality of cut off sections 10 arranged in parallel such that a plurality of conductive patterns joining the sub-electrodes 7*a* and 7*b* are formed in parallel. This enables the cut off section 10 of each conductive pattern to be made even narrower and with a higher resistance. When current flows through the sub-fuse element 4 in the current fuse 1, the plurality of cut off sections 10 blow in order and an arc discharge is generated when a final one of the cut off sections 10 blows. Since the plurality of cut off sections 10 arranged in parallel are even narrower, the blown sections are also narrower and the amount of melted metal is smaller. Therefore, explosive scattering can be prevented even when an arc discharge is generated.

[Insulating Layer]

The sub-fuse element 4 is preferably covered by an insulating layer 11. The insulating layer 11 is for example a layer having glass as a main component. Covering of the sub-fuse element 4 with the insulating layer 11 can prevent scattering of the cut off section 10 due to arc discharge. Furthermore, by evacuating air and covering the sub-fuse element 4 with the insulating layer 11 made from glass or the like, heat generated due to the flow of current can be efficiently dissipated via the insulating layer 11. This can prevent an arc discharge from continuing due to heat and can quickly suppress the arc discharge.

[Manufacturing Method]

The following describes a method of manufacturing the current fuse 1. First, the main electrodes 6*a* and 6*b*, the sub-electrodes 7*a* and 7*b*, and the sub-fuse element 4 are formed by printing Ag paste or the like onto the first and second surfaces 2*a* and 2*b* of the insulating substrate 2 and firing the Ag paste. During the above, the sub-fuse element 4 preferably includes a plurality of cut off sections 10 arranged in parallel at an approximately central position between the sub-electrodes 7*a* and 7*b* such that a plurality of conductive patterns joining the sub-electrodes 7*a* and 7*b* are formed.

Next, the main fuse element 3 is mounted on the first surface 2*a* of the insulating substrate 2. The main fuse element 3 is mounted on the main electrodes 6*a* and 6*b*. During mounting, the main fuse element 3 may be connected onto the main electrodes 6*a* and 6*b* via connection solder. The side wall sections 3*b* of the main fuse element 3 are fitted with the side surfaces 2*c* and 2*d* of the insulating substrate 2 such that the tips of the side wall sections 3*b* are in substantially a single plane with the second surface 2*b* of the insulating substrate 2. Finally, the protective cap 5 is mounted on the first surface 2*a* of the insulating substrate 2, straddling the main fuse element 3.

The current fuse 1 is mounted on the circuit substrate with the second surface 2*b* of the insulating substrate 2 as a mounting surface and with the tips of the side wall sections 3*b* of the main fuse element 3 and the sub-electrodes 7*a* and 7*b* connected to the connection electrodes on the circuit substrate via connection solder or the like. As a result, the current fuse 1 is incorporated into a current path of the circuit substrate and the main fuse element 3 and the sub-fuse element 4 are connected in parallel in the circuit.

[Fuse Operation]

The following describes operation of the current fuse 1 with reference to FIGS. 4-7. Note that the protective cap 5 is omitted in FIGS. 4-7. In an initial state in which a rated current is flowing through the current fuse 1, the majority of current flows through the main fuse element 3 having a lower resistance value than the sub-fuse element 4. Note that in a situation in which the main fuse element 3 and the sub-fuse element 4 of the current fuse 1 have approximately equal resistance values, current flows through both the main fuse element 3 and the sub-fuse element 4.

Figure 4B:
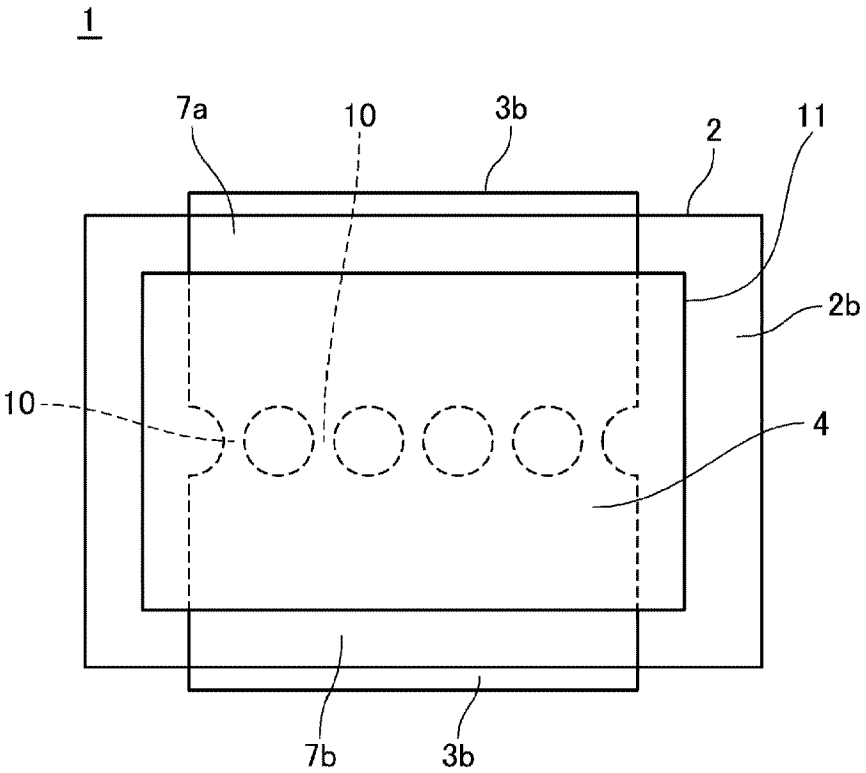
FIG. 4A is a plan view of the first surface side and FIG. 4B is a plan view of the second surface side, each illustrating the current fuse prior to operation.
Figure 4A:
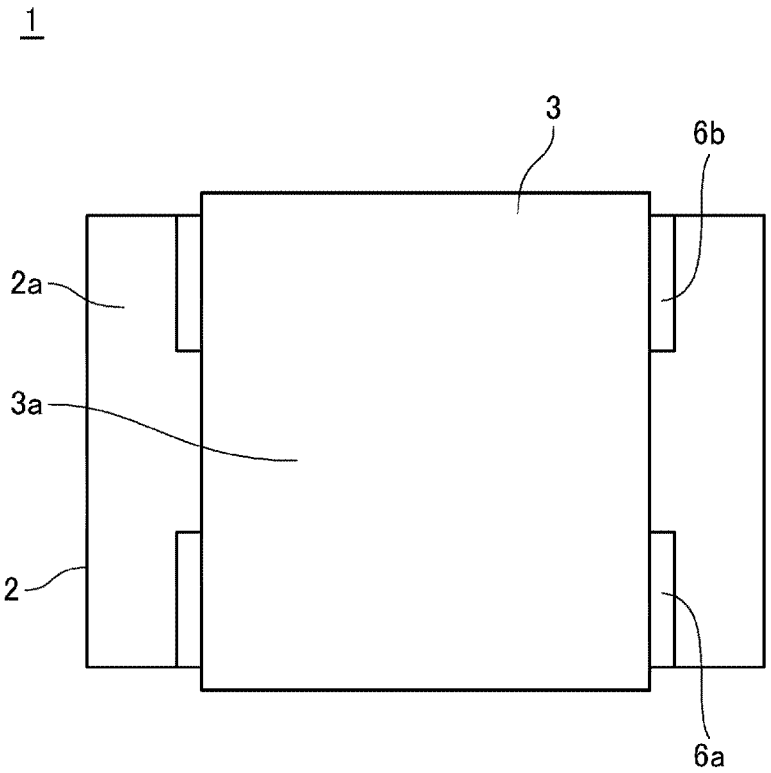

When an abnormality causes a current exceeding the rating to flow, as illustrated FIGS. 4A and 4B, heating begins from centrally on the main surface section 3*a* of the main fuse element 3, which has a relatively low melting point, and this leads to blowing thereof. Note that even if current flows through the sub-fuse element 4 as well as the main fuse element 3, the main fuse element 3 blows first because the sub-fuse element 4 has a high melting point and takes time to blow by self-heating. Moreover, forming the sub-fuse element 4 with a higher resistance than the main fuse element 3 also causes the main fuse element 3 to blow first since the majority of current flows through the main fuse element 3.

Figure 5B:
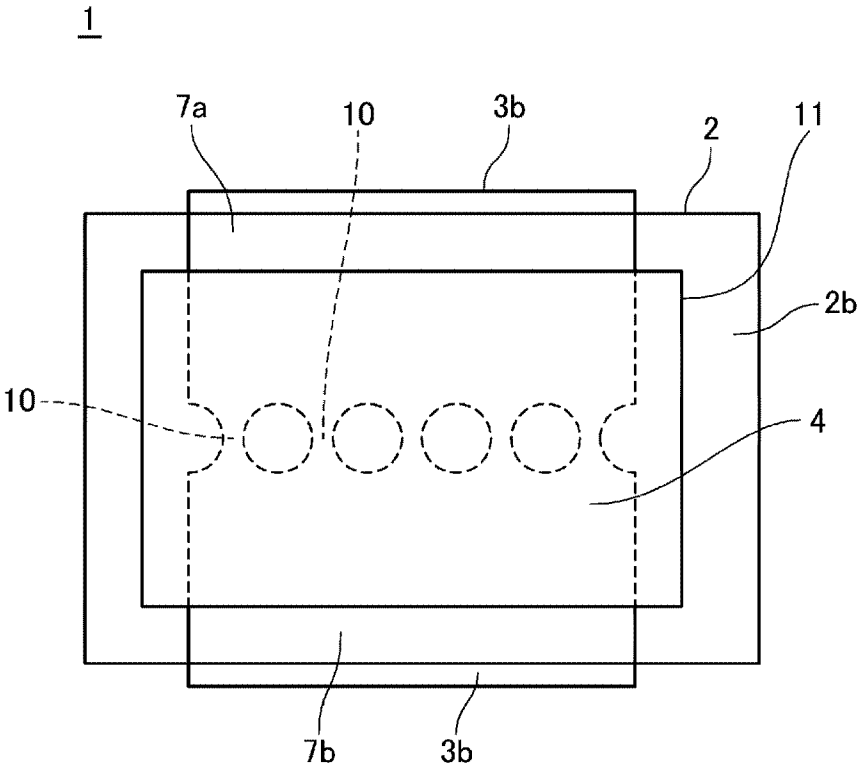
FIG. 5A is a plan view of the first surface side and FIG. 5B is a plan view of the second surface side, each illustrating the current fuse after the main fuse element has blown.
Figure 5A:
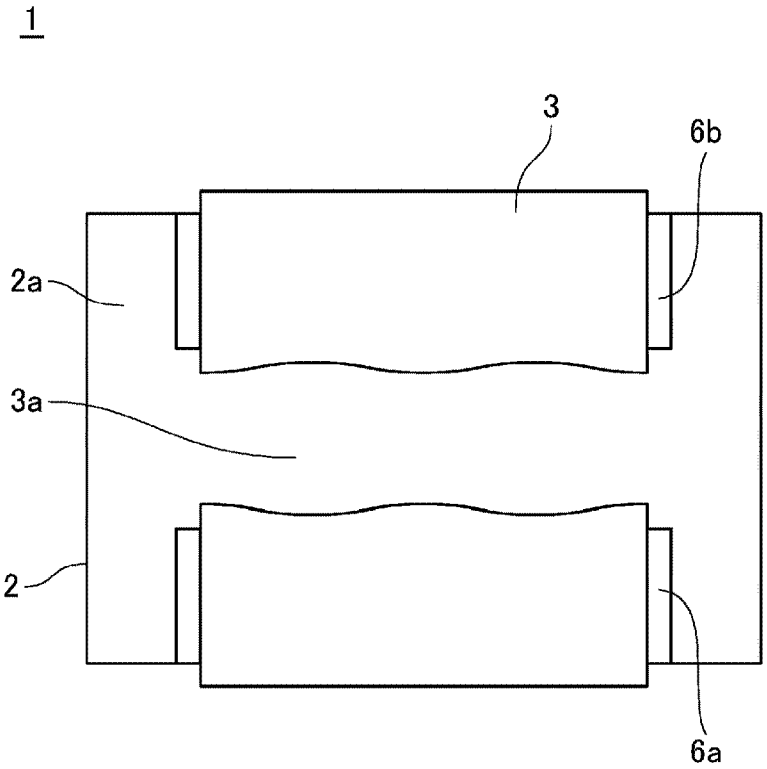
Figure 6B:
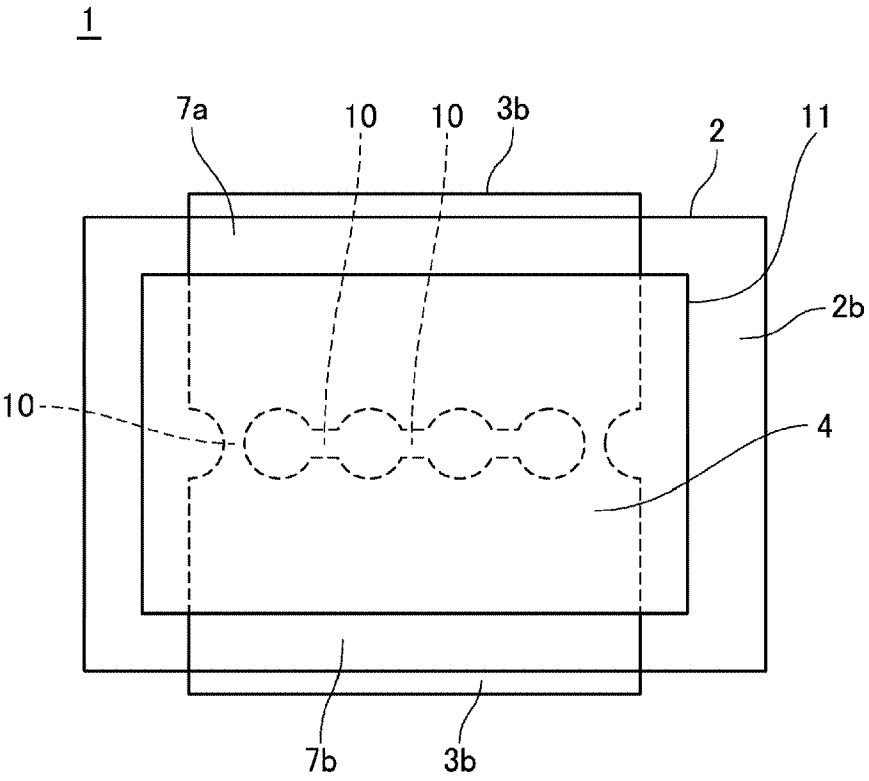
FIG. 6A is a plan view of the first surface side and FIG. 6B is a plan view of the second surface side, each illustrating the current fuse while a sub-fuse element is blowing.
Figure 6A:
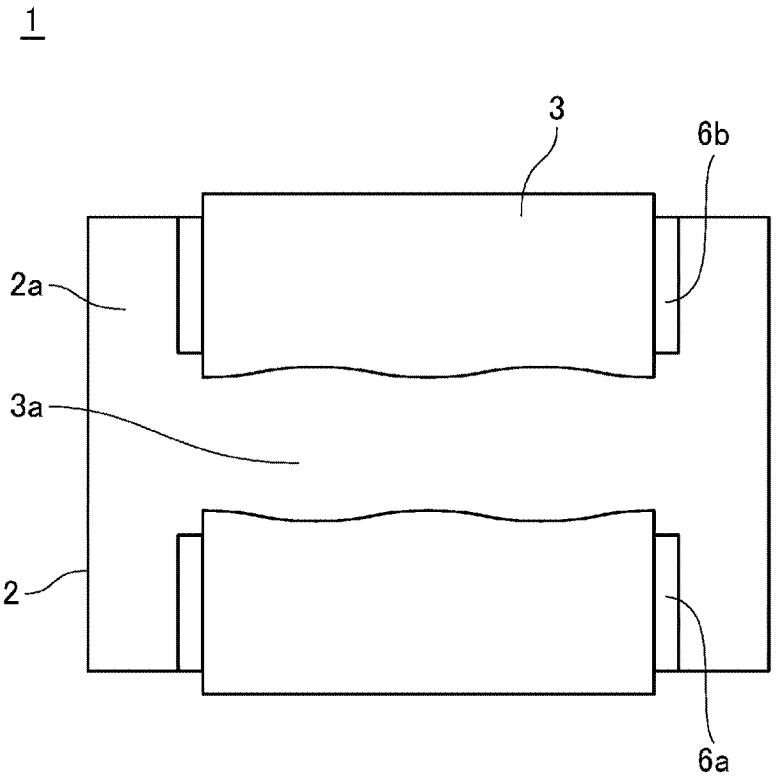
Figure 7B:
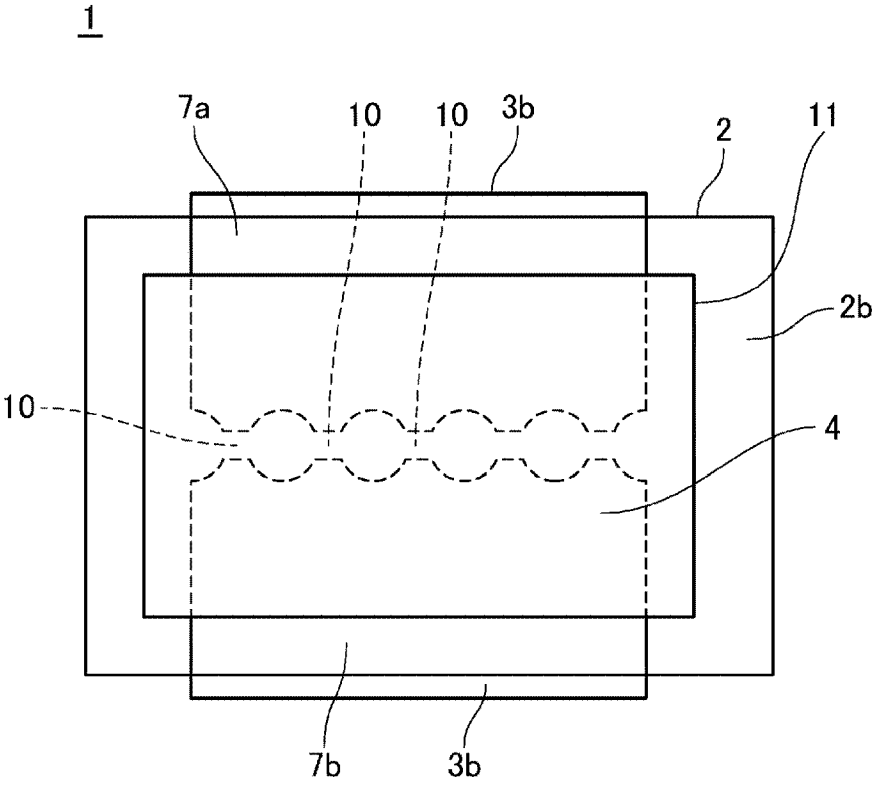
FIG. 7A is a plan view of the first surface side and FIG. 7B is a plan view of the second surface side, each illustrating the current fuse after the sub-fuse element has completely blown.
Figure 7A:
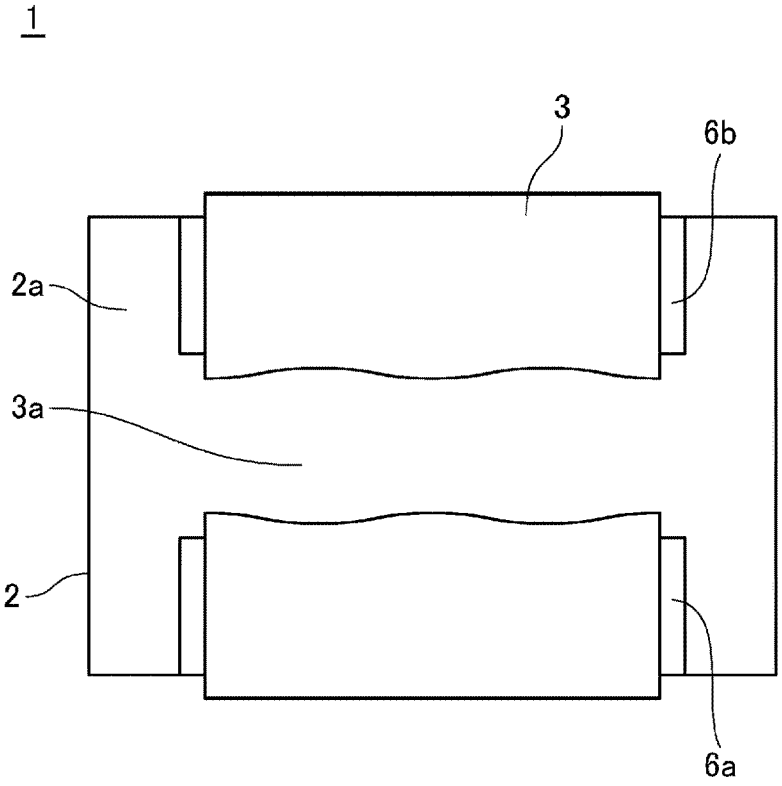

When the main fuse element 3 blows as illustrated in FIGS. 5A and 5B, all current flows through the sub-fuse element 4 connected in parallel to the main fuse element 3. As illustrated in FIGS. 6A and 6B, the sub-fuse element 4 starts generating heat and blowing at locations among the plurality of cut off sections 10 where the resistance value is relatively low. The circuit is cut off through blowing of the final one of the cut off sections 10 as illustrated in FIGS. 7A and 7B.

According to the current fuse 1, once the main fuse element 3 blows, current flows through the sub-fuse element 4 connected in parallel to the main fuse element 3, which can prevent generation of an arc discharge across the blown main fuse element 3. This can prevent explosive scattering of low melting point metal forming the main fuse element 3.

Furthermore, according to the current fuse 1, providing the cut off sections 10 that are narrower and thus have a higher resistance than other sections of the sub-fuse element 4 causes blowing to occur at the cut off sections 10. Since the amount of melted metal from the cut off sections 10 is small, explosive scattering can be inhibited even if an arc discharge is generated at a blown section.

According to the current fuse 1, arranging the plurality of cut off sections 10 in parallel to provide a plurality of narrower conductive patterns can further reduce the amount of melted metal from the cut off sections 10 when blowing occurs and prevent explosive scattering of melted metal in association with arc discharge.

Moreover, according to the current fuse 1, covering the sub-fuse element 4 with the insulating layer 11 can effectively suppress arc discharge generation and prevent explosive scattering of melted metal. Furthermore, heat from self-heating in the current fuse 1 can be dissipated more efficiently in a configuration in which the sub-fuse element 4 is covered by the insulating layer 11 than in a configuration in which the sub-fuse element 4 is exposed to air. Therefore, even when an arc discharge is generated upon blowing of the final one of the cut off sections 10, heat therefrom can be efficiently dissipated and the arc discharge can be quickly suppressed.

[Modified Examples]

Figure 8A:
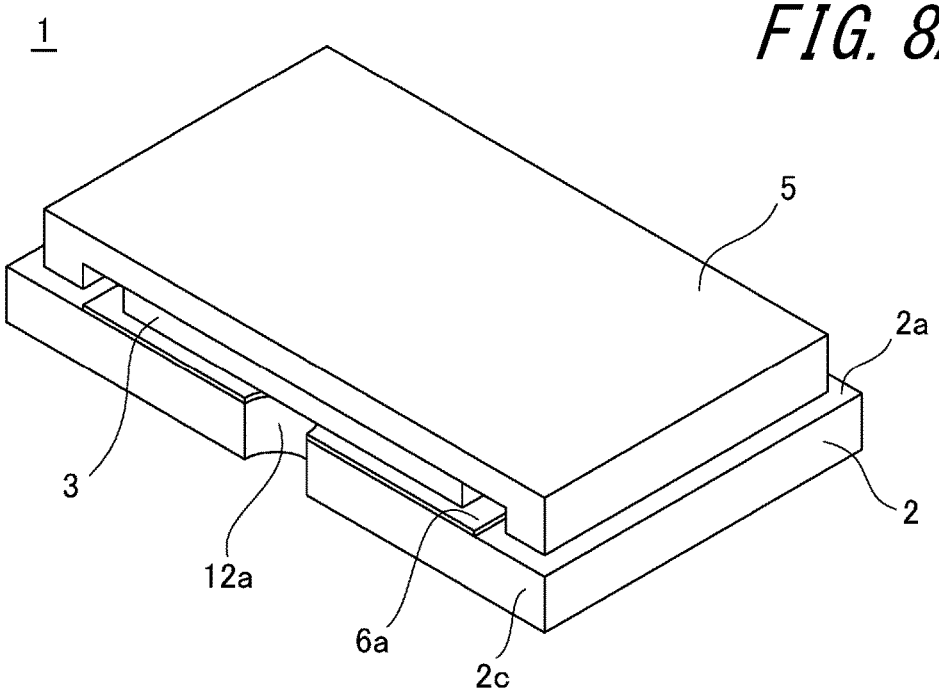
FIG. 8A is an external perspective view of a first surface side and FIG. 8B is an external perspective view of a second surface side, each illustrating a current fuse including side surface electrodes on an insulating substrate.
Figure 8B:
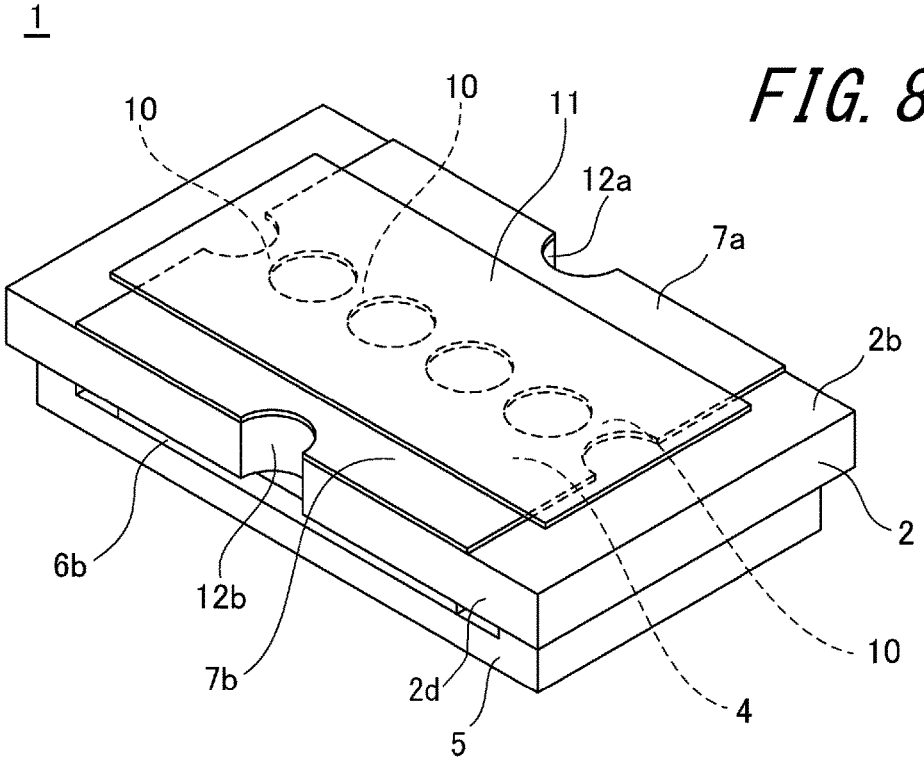

As illustrated in FIGS. 8A and 8B, the current fuse 1 may include a side surface electrode 12*a* disposed on the side surface 2*c* of the insulating substrate 2 and electrically connecting the main electrode 6*a* and the sub-electrode 7*a*, and a side surface electrode 12*b* disposed on the side surface 2*d* of the insulating substrate 2 and electrically connecting the main electrode 6*b* and the sub-electrode 7*b*. As a result of the current fuse 1 including the side surface electrodes 12*a* and 12*b*, the main electrode 6*a* is connected to the sub-electrode 7*a* and the main electrode 6*b* is connected to the sub-electrode 7*b*. The current fuse 1 is therefore configured such that the main fuse element 3 mounted on the main electrodes 6*a* and 6*b* is electrically connected to the sub-fuse element 4 connected to the sub-electrodes 7*a* and 7*b*.

Moreover, as a result of the current fuse 1 including the side surface electrodes 12*a* and 12*b*, current resistance to the main fuse element 3 can be reduced compared to the sub-fuse element 4 and arc discharge generation at the blown main fuse element 3 can be suppressed.

Note that the current fuse 1 may include through-hole electrodes electrically connecting the main electrodes 6*a* and 6*b* to the sub-electrodes 7*a* and 7*b*, either in place of or in addition to the side surface electrodes 12*a* and 12*b*. Furthermore, as illustrated in FIGS. 8A and 8B, the side wall sections 3*b* may be omitted such that the main fuse element 3 only includes the main surface section 3*a* connected to the main electrodes 6*a* and 6*b*.

In a situation in which the side wall sections 3*b* are omitted, the protective cap 5 may be an enclosing type cap that encloses the main fuse element 3 on the first surface 2*a* of the insulating substrate 2, rather than a partially open type cap allowing the side wall sections 3*b* to be led out therefrom (refer to FIG. 1A). The suppressing effect of the current fuse 1 on arc discharge at the main fuse element 3 also inhibits occurrence of a situation in which the protective cap 5 is dislodged due to explosive scattering of melted metal.

[Fitting Recesses]

Figure 9A:
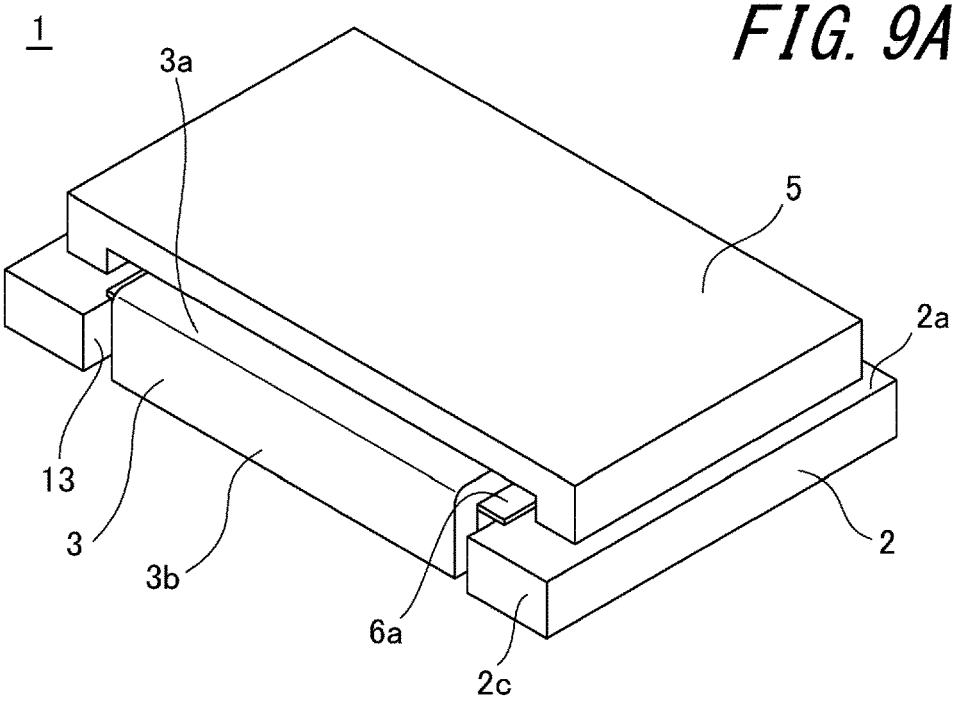
FIG. 9A is an external perspective view of a first surface side and FIG. 9B is an external perspective view of a second surface side, each illustrating a current fuse including fitting recesses on an insulating substrate.
Figure 9B:
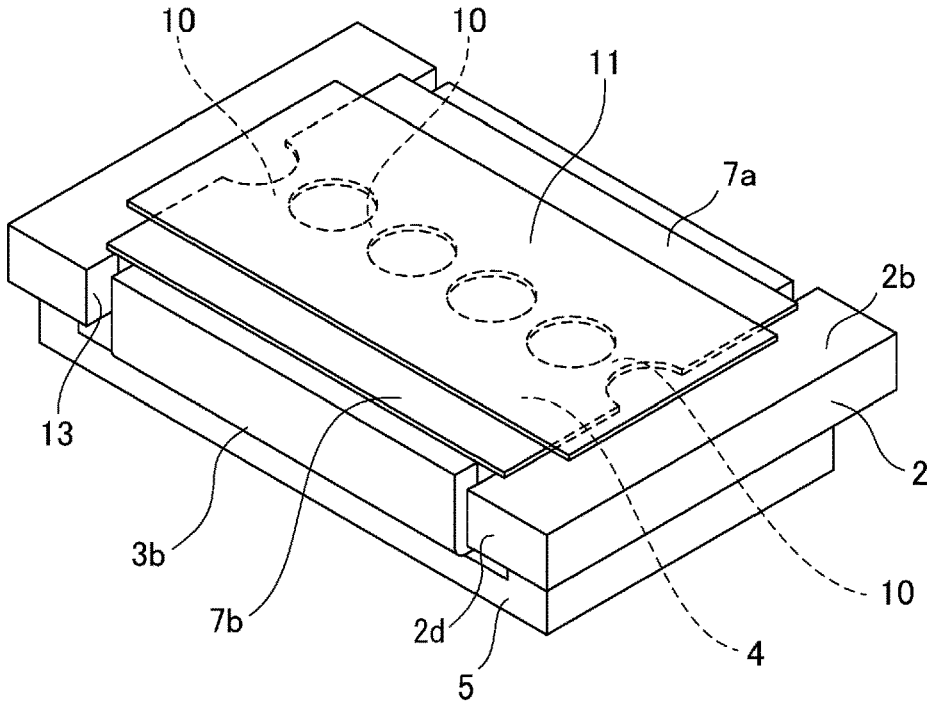

As illustrated in FIGS. 9A and 9B, the current fuse 1 may include fitting recesses 13 on the side surfaces 2*c* and 2*d* of the insulating substrate 2 that fit with the side wall sections 3*b* of the main fuse element 3. The fitting recesses 13 preferably have a depth that is at least as large as the thickness of the side wall sections 3*b*. This can prevent the side wall sections 3*b* from protruding out from the side surfaces 2*c* and 2*d* of the insulating substrate 2 when the side wall sections 3*b* are fitted with the fitting recesses 13. Furthermore, by including the fitting recesses 13, the current fuse 1 enables fixing of the main fuse element 3 in position and enables improved manufacturing efficiency by making it possible to mount the main fuse element 3 or the protective cap 5 on a multiple surface mounting substrate.

[Electrode Surface Coating Treatment]

In the current fuse 1, surfaces of the main electrodes 6*a* and 6*b*, the sub-electrodes 7*a* and 7*b*, and the sub-fuse element 4 may be coated with Ni/Au plating, Ni/Pd plating, Ni/Pd/Au plating, or the like by commonly known plating treatment. This plating treatment can prevent oxidation of the main electrodes 6*a* and 6*b*, the sub-electrodes 7*a* and 7*b*, and the sub-fuse element 4 of the current fuse 1. Moreover, erosion (solder erosion) of the main electrodes 6*a* and 6*b*, the sub-electrodes 7*a* and 7*b*, and the sub-fuse element 4 can be prevented from occurring when connection solder connecting the main fuse element 3 or low melting point metal forming an outer layer of the main fuse element 3 melts in a situation in which the current fuse 1 is reflow mounted or in a state directly prior to excessive current being cut off.

[Main Fuse Element Configuration]

Figure 10A:
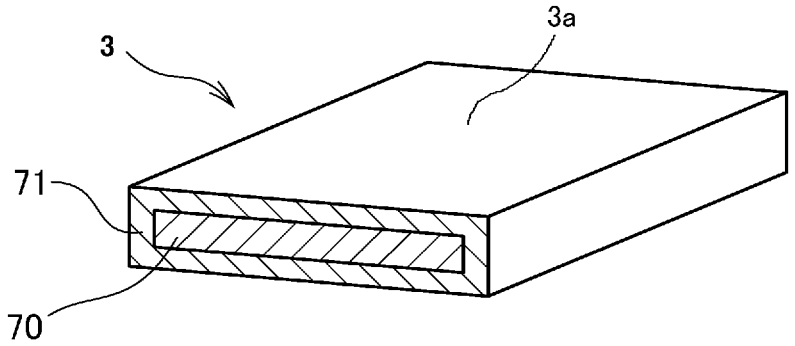
FIG. 10A is a perspective view illustrating a fusible conductor having a coated structure in which a high melting point metal layer forms an inner layer coated by a low melting point metal layer and FIG. 10B is a perspective view illustrating a fusible conductor having a coated structure in which a low melting point metal layer forms an inner layer coated by a high melting point metal layer.

The main fuse element 3 may contain a low melting point metal and a high melting point metal as previous described. The low melting point metal is preferably solder, such as Pb-free solder having Sn as a main component, and the high melting point metal is preferably Ag, Cu, or an alloy having Ag or Cu as a main component. In such a situation, the main fuse element 3 may be a fusible conductor such as illustrated in FIG. 10A that includes a high melting point metal layer 70 as an inner layer and a low melting point metal layer 71 as an outer layer. This main fuse element 3 may have a structure in which all surfaces of the high melting point metal layer 70 are covered by the low melting point metal layer 71 or a structure in which all surfaces of the high melting point metal layer 70 are covered with the exception of a pair of opposite side surfaces. A coated structure of the high melting point metal layer 70 and the low melting point metal layer 71 can be formed by a commonly known film formation technique such as plating.

Figure 10B:
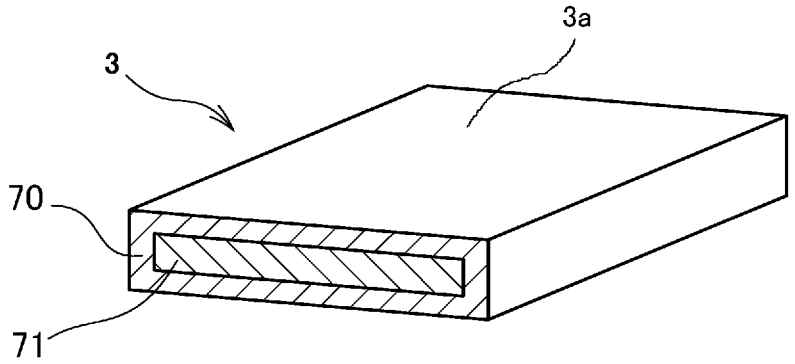

The main fuse element 3 may alternatively be a fusible conductor such as illustrated in FIG. 10B that includes a low melting point metal layer 71 as an inner layer and a high melting point metal layer 70 as an outer layer. This main fuse element 3 may have a structure in which all surfaces of the low melting point metal layer 71 are covered by the high melting point metal layer 70 or a structure in which all surfaces of the low melting point metal layer 71 are covered with the exception of a pair of opposite side surfaces.

Figure 11A:
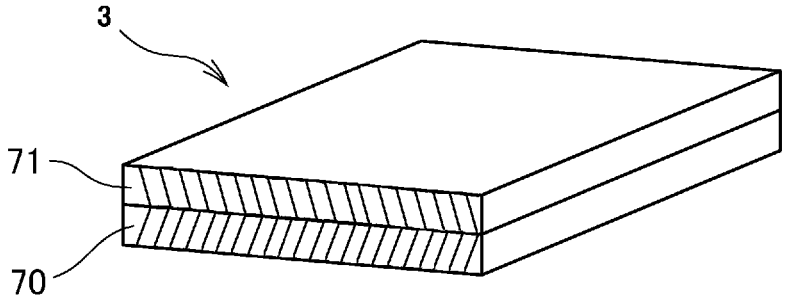
FIG. 11A is a perspective view illustrating a fusible conductor having a two-layer structure in which a high melting point metal layer and a low melting point metal layer form upper and lower layers and FIG. 11B is a perspective view illustrating a fusible conductor having a three-layer structure in which a high melting point metal layer and a low melting point metal layer form inner and outer layers.
Figure 11B:
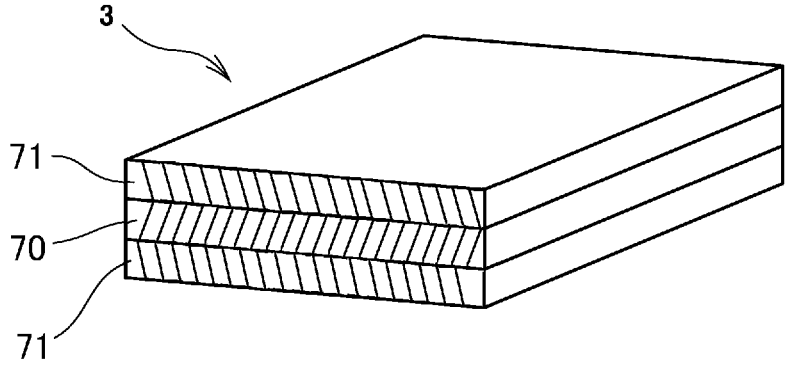

The main fuse element 3 may alternatively have a layered structure such as illustrated in FIGS. 11A and 11B in which a high melting point metal layer 70 and a low melting point metal layer 71 are laminated.

In such a situation, the layered structure of the main fuse element 3 may be a two-layer structure in which a lower layer is mounted on the main electrodes 6 and an upper layer is laminated on the lower layer and in which a low melting point metal layer 71 forms the upper layer laminated on the upper surface of a high melting point metal layer 70 forming the lower layer as illustrated in FIG. 11A; conversely, a high melting point metal layer 70 forming the upper layer may be laminated on the upper surface of a low melting point metal layer 71 forming the lower layer. Alternatively, the layered structure of the main fuse element 3 may be a three-layer structure in which outer layers are laminated on upper and lower surfaces of an inner layer and in which low melting point metal layers 71 forming the outer layers are laminated on upper and lower surfaces of a high melting point metal layer 70 forming the inner layer as illustrated FIG. 11B; conversely, high melting point metal layers 70 forming the outer layers may be laminated on upper and lower surfaces of a low melting point metal layer 71 forming the inner layer.

Figure 12:
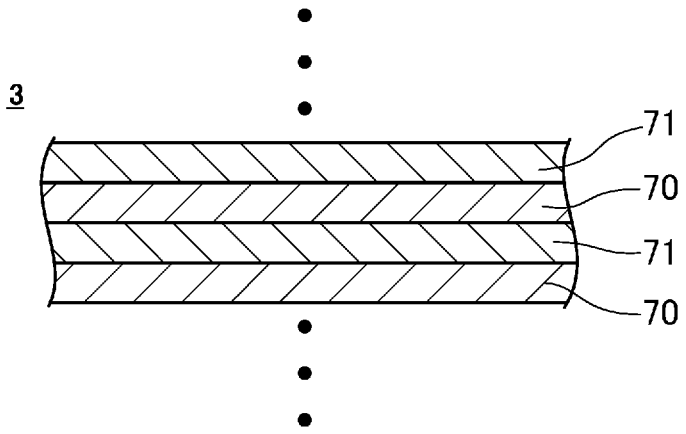
FIG. 12 is a cross-sectional view illustrating a fusible conductor having a multi-layer structure of high melting point metal layers and low melting point metal layers.

The main fuse element 3 may alternatively have a multi-layer structure in which four or more layers of high melting point metal layers 70 and low melting point metal layers 71 are laminated alternately as illustrated in FIG. 12. In such a situation, the main fuse element 3 may have a structure in which all surfaces are covered by a metal layer forming an outermost layer or in which all surfaces with the exception of a pair of opposite side surfaces are covered by the metal layer forming the outermost layer.

Figure 13A:
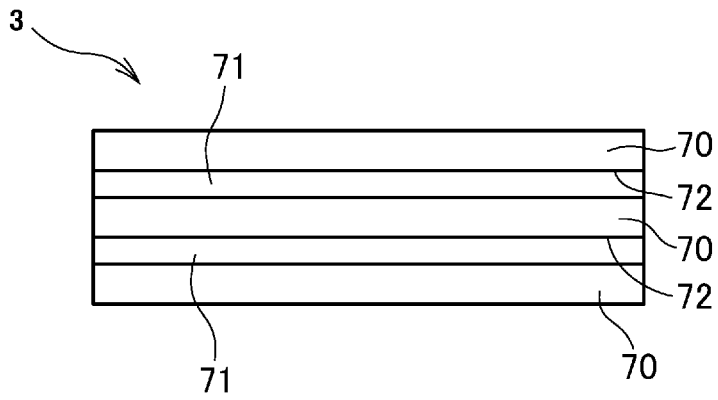
FIG. 13A is a plan view illustrating a fusible conductor in which line-shaped aperture sections are formed in a longitudinal direction in the surface of a high melting point metal layer to expose a low melting point metal layer and FIG. 13B is a plan view illustrating a fusible conductor in which line-shaped aperture sections are formed in a width direction in the surface of a high melting point metal layer to expose a low melting point metal layer.
Figure 13B:
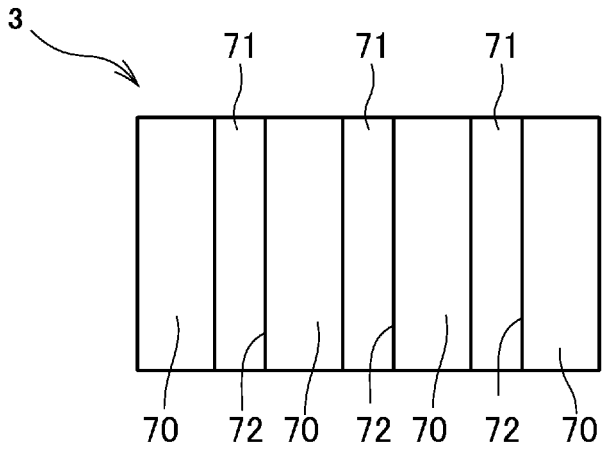

Alternatively, the main fuse element 3 may include a high melting point metal layer 70 laminated as stripe-shaped sections on the surface of a low melting point metal layer 71 forming an inner layer. FIGS. 13A and 13B are plan view illustrating the main fuse element 3.

The main fuse element 3 illustrated in FIG. 13A includes a high melting point metal layer 70 formed as a plurality of longitudinal direction line-shaped sections at prescribed intervals in a width direction on the surface of a low melting point metal layer 71 such that line-shaped aperture sections 72 are formed along the longitudinal direction and the low melting point metal layer 71 is exposed through the aperture sections 72. As a result of the main fuse element 3 having the low melting point metal layer 71 exposed through the aperture sections 72, contact surface area between high melting point metal and melted low melting point metal can be increased, erosive action on the high melting point metal layer 70 can be promoted, and blowing characteristics can be improved. The aperture sections 72 can for example be formed by partial plating of a metal forming the high melting point metal layer 70 on the low melting point metal layer 71.

Alternatively, as illustrated FIG. 13B, the main fuse element 3 may include a high melting point metal layer 70 formed as a plurality of width direction line-shaped sections at prescribed intervals in a longitudinal direction on the surface of a low melting point metal layer 71 such that line-shaped aperture sections 72 are formed along the width direction.

Figure 14:
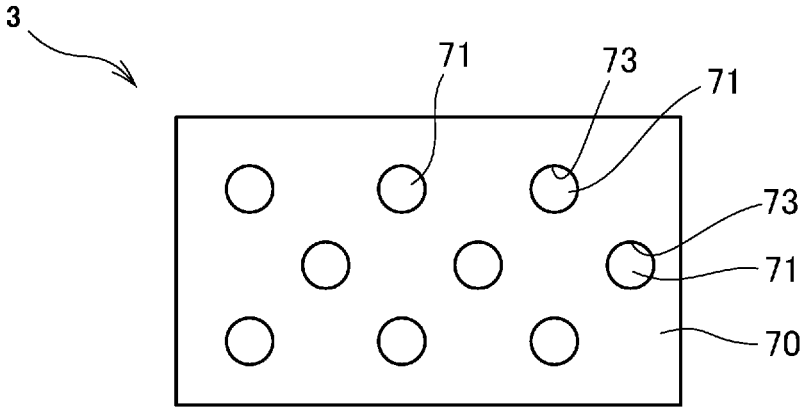
FIG. 14 is a plan view illustrating a fusible conductor in which circular aperture sections are formed in the surface of a high melting point metal layer to expose a low melting point metal layer.

Alternatively, as illustrated in FIG. 14, the main fuse element 3 may include a high melting point metal layer 70 on the surface of a low melting point metal layer 71 and circular aperture sections 73 may be present across the entire surface of the high melting point metal layer 70 such that the low melting point metal layer 71 is exposed through the aperture sections 73. The aperture sections 73 can for example be formed by partial plating of a metal forming the high melting point metal layer 70 on the low melting point metal layer 71.

As a result of the main fuse element 3 having the low melting point metal layer 71 exposed through the aperture sections 73, contact surface area between high melting point metal and melted low melting point metal can be increased, erosive action on the high melting point metal can be promoted, and blowing characteristics can be improved.

Figure 15:
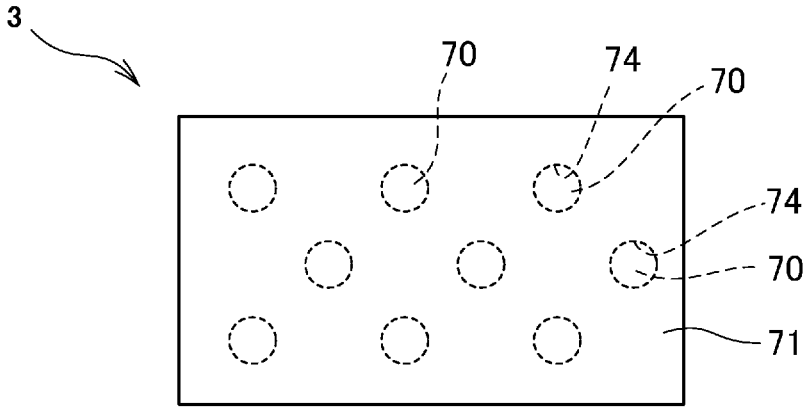
FIG. 15 is a plan view illustrating a fusible conductor in which circular aperture sections formed in a high melting point metal layer are internally filled with a low melting point metal.

Alternatively, as illustrated in FIG. 15, the main fuse element 3 may include a high melting point metal layer 70 in which numerous aperture sections 74 are present as an inner layer and a low melting point metal layer 71 may be formed as a film on the high melting point metal layer 70 by a plating technique or the like such as to fill the aperture sections 74. This increases the contact surface area between high melting point metal and melted low melting point metal in the main fuse element 3 such that the low melting point metal can erode the high melting point metal more quickly.

In the main fuse element 3, the low melting point metal layer 71 preferably has a larger volume than the high melting point metal layer 70. The main fuse element 3 is heated by excessive current exceeding the rated current value such that the low melting point metal melts and erodes the high melting point metal, thereby enabling quicker melting and blowing. Therefore, the erosive action described above can be promoted and cutting off between the main electrodes 6*a* and 6*b* can occur quickly as a result of the low melting point metal layer 71 having a larger volume than the high melting point metal layer 70 in the main fuse element 3.

Figure 16:
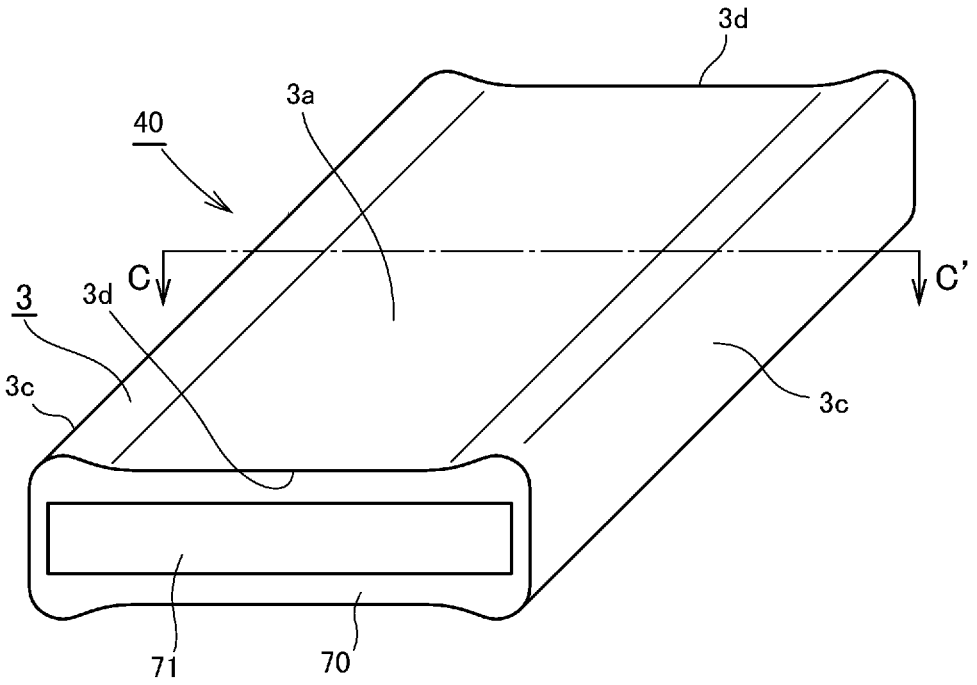
FIG. 16 is a perspective view illustrating a fusible conductor in which a low melting point metal surrounded by a high melting point metal is exposed.

As illustrated in FIG. 16, the main fuse element 3 may include a pair of opposite first edge sections 3*c* that have a roughly rectangular plate shape, are covered by a high melting point metal forming an outer layer, and are thicker than the main surface section 3*a* and a pair of opposite second edge sections 3*d* that are thinner than the first edge sections 3*c* and at which a low melting point metal forming an inner layer is exposed. The main fuse element 3 may be connected across the main electrode 6*a* and the main electrode 6*b* such that the second edge sections 3*d* are at opposite sides running in a direction in which current flows through the main fuse element 3.

The first edge sections 3*c* have side surfaces that are covered by the high melting point metal layer 70 and, as a result, are thicker than the main surface section 3*a* of the main fuse element 3. The second edge sections 3*d* have side surfaces at which the low melting point metal layer 71 is exposed and at which the perimeter of the low melting point metal layer 71 is surrounded by the high melting point metal layer 70. The second edge sections 3*d* have the same thickness as the main surface section 3*a* with the exception of both ends of each of the second edge sections 3*d*, which are adjacent to the first edge sections 3*c*.

Figure 17:
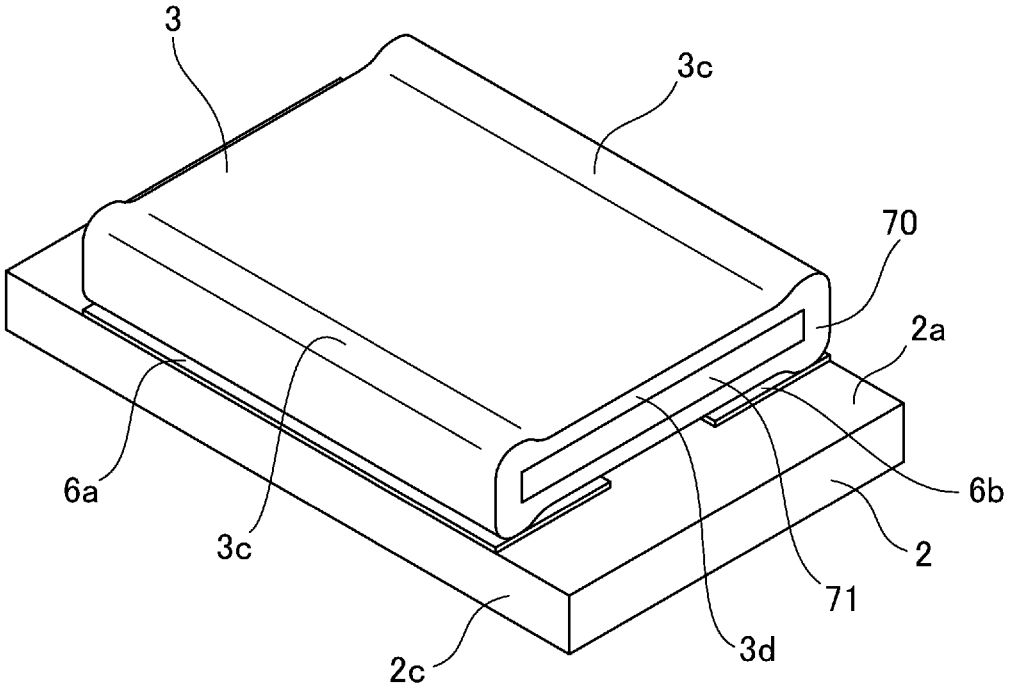
FIG. 17 is a cross-sectional view illustrating a short circuit element in which the fusible conductor in FIG. 16 is used, with a protective cap omitted.

The main fuse element 3 is positioned as illustrated in FIG. 17 with the second edge sections 3*d* oriented along a current path of the main fuse element 3 passing between the main electrode 6*a* and the main electrode 6*b*. As a result, the main fuse element 3 across the main electrodes 6*a* and 6*b* in the current fuse 1 can be quickly melted to cause a short circuit. Note that the protective cap 5 is omitted in FIG. 17.

In other words, the second edge sections 3*d* are relatively thin compared to the first edge sections 3*c*. Moreover, the low melting point metal layer 71 forming the inner layer is exposed at the side surfaces of the second edge sections 3*d*. As a result, the erosive action of the low melting point metal layer 71 on the high melting point metal layer 70 acts at the second edge sections 3*d* and the thickness of the high melting point metal layer 70 that is eroded is relatively thin at the second edge sections 3*d* compared to at the first edge sections 3*c*. Therefore, melting can occur quicker and with less thermal energy at the second edge sections 3*d* than at the first edge sections 3*c* that are thick due to the high melting point metal layer 70.

The main fuse element 3 having the configuration described above can be manufactured by coating a low melting point metal foil forming the low melting point metal layer 71, such as a solder foil, with a metal forming the high melting point metal layer 70, such as Ag. One process for coating a low melting point metal layer foil with a high melting point metal that is advantageous in terms of operation efficiency and manufacturing cost is an electroplating process in which an elongated low melting point metal foil is continuously plated with a high melting point metal.

When carrying out high melting point metal plating by electroplating, a high melting point metal layer 70 is plated relatively thickly at edge sections of the elongated low melting point metal film because the electric field is relatively strong at the edge sections (refer to FIG. 16). As a result, an elongated conductive ribbon 40 is formed having thick edge sections due to the high melting point metal layer. Next, the conductive ribbon 40 is cut to a prescribed length by cutting in a width direction (direction C-C' in FIG. 16) perpendicular to a longitudinal direction to manufacture the main fuse element 3. As a result, the edge sections of the conductive ribbon 40 become the first edge sections 3*c* of the main fuse element 3 and the cut surfaces of the conductive ribbon 40 become the second edge sections 3*d* of the main fuse element 3. Moreover, the first edge sections 3*c* are covered by the high melting point metal whereas the second edge sections 3*d* have end surfaces (cut surfaces of the conductive ribbon 40) at which the low melting point metal layer 71 is externally exposed and is sandwiched between a pair of high melting point metal layers 70 above and below the low melting point metal layer 71.

REFERENCE SIGNS LIST

1 current fuse
2 insulating substrate
2*a* first surface
2*b* second surface
2*c*, 2*d* side surface
3 main fuse element
3*a* main surface section
3*b* side wall section
4 sub-fuse element
5 protective cap
6 main electrode
7 sub-electrode
10 cut off section
11 insulating layer
12 side surface electrode
13 fitting recess

The invention claimed is:

1. A current fuse comprising:
an insulating substrate;
a main fuse element that is disposed on the insulating substrate and contains a low melting point metal and a high melting point metal; and
a sub-fuse element disposed on the insulating substrate and having a higher melting point than the main fuse element, wherein
the main fuse element and the sub-fuse element are connected in parallel,
a resistance value of the main fuse element is less than or equal to a resistance value of the sub-fuse element,
a melting temperature of the low melting point metal is less than a reflow temperature at the time reflow mounting on a circuit substrate, and
the main fuse element has a coated structure in which the low melting point metal forms an inner layer and the high melting point metal forms an outer layer.

2. The current fuse of claim 1, wherein
the main fuse element is disposed on one surface of the insulating substrate, and
the sub-fuse element is disposed on an opposite surface of the insulating substrate.

3. The current fuse of claim 2, wherein
the sub-fuse element is a conductive pattern joining a first electrode and a second electrode disposed on the insulating substrate.

4. The current fuse of claim 1, wherein
the sub-fuse element is a conductive pattern having silver or copper as a main component.

5. The current fuse of claim 1, wherein
the sub-fuse element includes a cut off section at which the sub-fuse elements narrows.

6. The current fuse of claim 1, wherein
the sub-fuse element is a plurality of conductive patterns arranged in parallel.

7. The current fuse of claim 1, wherein
the sub-fuse element is covered by an insulating layer.

8. The current fuse of claim 7, wherein
the insulating layer has glass as a main component.

9. The current fuse of claim 1, wherein the insulating substrate is a ceramic substrate or a glass-epoxy printed substrate.

10. The current fuse of claim 1, wherein a third electrode and a fourth electrode are disposed on one surface of the insulating substrate, and the main fuse element is mounted so as to straddle between the third electrode and the fourth electrode.

11. The current fuse of claim 1, wherein a third electrode and a fourth electrode disposed on one surface of the insulating substrate are respectively continuous with a first electrode and a second electrode disposed on an opposite surface of the insulating substrate via a through-hole electrode or a side surface electrode.

12. The current fuse of claim 1, wherein the main fuse element is connected to a third electrode and a fourth electrode disposed on one surface of the insulating substrate via connection solder.

13. The current fuse of claim 1, wherein the main fuse element is mounted on one surface of the insulating substrate and is fitted with a side surface of the insulating surface or at an opposite surface of the insulating substrate via the side surface of the insulating substrate.

14. The current fuse of claim 1, wherein a protective member is mounted over the main fuse element.

15. The current fuse of claim 1, wherein the main fuse element and the sub-fuse element are connected to connection electrodes of a circuit substrate on which the current fuse is mounted and are connected to one another in parallel via the connection electrode.

16. The current fuse of claim 1, wherein the low melting point metal is configured to melt and erode the high melting point metal.

17. The current fuse of claim 16, wherein the low melting point metal is solder, and the high melting point metal is Ag, Cu, or an alloy having Ag or Cu as a main component.

18. The current fuse of claim 1, wherein the high melting point metal is disposed on the surface of an inner layer made from the low melting point metal, and an aperture section is present in the high melting point metal.

19. The current fuse of claim 1, wherein the main fuse element includes a main surface section, a pair of opposite first edge sections coated by an outer layer of the high melting point metal and having a greater thickness than the main surface section, and a pair of opposite second edge sections having a smaller thickness than the first edge sections and at which the low melting point metal forming an inner layer is exposed, and the main fuse element is oriented with the second edge sections as opposite sides running in a direction in which current passes through the main fuse element.

20. A current fuse comprising:

a main fuse element that contains a low melting point metal and a high melting point metal; and a sub-fuse element having a higher melting point than the main fuse element, wherein a resistance value of the main fuse element is less than or equal to a resistance value of the sub-fuse element, the main fuse element and the sub-fuse element are connected in parallel, a melting temperature of the low melting point metal is less than a reflow temperature at the time reflow mounting on a circuit substrate, and the main fuse element has a coated structure in which the low melting point metal forms an inner layer and the high melting point metal forms an outer layer.

* * * * *